United States Patent [19]

Petersen

[11] Patent Number: 4,458,847

[45] Date of Patent: Jul. 10, 1984

[54] DOSAGE GRANULATOR FOR TEARING UP A MATERIAL OF HIGH VISCOSITY

[75] Inventor: Claus C. Petersen, Kolding, Denmark

[73] Assignee: A/S Phønix, Tagpap og Vejmaterialer, Vejen, Denmark

[21] Appl. No.: 337,362

[22] Filed: Jan. 6, 1982

[30] Foreign Application Priority Data

Jan. 19, 1981 [DK] Denmark ..... 222/81

[51] Int. Cl.[3] ..... B02C 19/12

[52] U.S. Cl. ..... 241/36; 241/142; 241/237; 241/243; 241/283

[58] Field of Search ..... 241/36, 101.5, 101.6, 241/135, 142, 224, 237, 239, 242, 243, 283, 46.17

[56] References Cited

U.S. PATENT DOCUMENTS

| | | | |
|---|---|---|---|
| 1,150,219 | 8/1915 | Monahan | 241/242 |
| 2,165,047 | 7/1939 | Gualdoni | 241/36 X |
| 2,652,984 | 9/1953 | Dodds | 241/135 |
| 3,181,800 | 5/1965 | Noren et al. | 241/36 X |
| 3,703,970 | 11/1972 | Benson | 241/36 X |
| 3,995,819 | 12/1976 | Kunogi et al. | 241/101.6 X |
| 4,325,641 | 4/1982 | Babus et al. | 241/46.17 |

FOREIGN PATENT DOCUMENTS

| | | |
|---|---|---|
| 133935 | 8/1976 | Denmark . |
| 2338108 | 3/1974 | Fed. Rep. of Germany . |
| 1372776 | 11/1974 | United Kingdom . |

OTHER PUBLICATIONS

National Asphalt Pavement Association–Information Series 71, 11–1979.

Strabag Bau–AG Drawing 6800, dated 1973.

*Primary Examiner*—Mark Rosenbaum

*Attorney, Agent, or Firm*—Cushman, Darby & Cushman

[57] ABSTRACT

The dosage granulator comprises a feed hopper receiving reclaimed asphalt to be granulated. Under the lower opening of the feed hopper, a tearing up device is situated which is controlled by a conveyor type weigher mounted thereunder. The tearing up device comprises tearing rollers with knives, gratings, and a plurality of pressure arms reciprocating through the spaces of the gratings to press the material downwards. The tearing rollers rotate to drive the material towards the gratings, where it is cut by the knives in co-operation with said gratings. The dosage granulator may comprise a reciprocating stirrer situated between the tearing rollers. Reclaimed asphalt of a size of up to 30 cm may thereby be cut into granules of 5 cm. The amount of granulated material is adjusted by means of the conveyor tape weigher.

10 Claims, 4 Drawing Figures

DOSAGE GRANULATOR FOR TEARING UP A MATERIAL OF HIGH VISCOSITY

Figure 1:
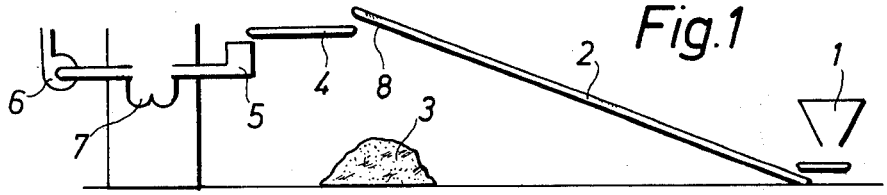

The present invention relates to a dosage granulator especially for tearing up a material of high viscosity, especially lumpy reclaimed asphalt, and comprising a feed hopper, a tearing up device, and a conveying member placed thereunder.

Granulators for tearing up asphalt milled up are known, whereby the asphalt milled up upon granulation is fed by means of a conveyor to the screening and mixing part of an asphalt mixing machine. In this part of the asphalt mixing machine, extra bitumen and gravel aggregate are added according to requirement for the production of a finished asphalt product. A known granulator of this type comprises a feed hopper, one wall surface of which forms an angle of about 45° with the vertical, whereas the other side wall is formed by a substantially circular granulating tongue co-operating with a tearing roller of a smaller diameter than said granulating tongue. The tearing roller is provided with teeth and is located above the outlet of the hopper, said outlet being formed between the granulating tongue and the lower edges of the side wall. In use, the tearing roller carries the asphalt mass milled up upwards and forwards towards the tearing tongue, where said mass is granulated between the tearing roller and the granulating tongue so as subsequently to be carried downwards through a lower hopper to a conveyor path and further on to the asphalt mixing machine. Though this machine is suited for granulating asphalt taken up to a desired granule size, asphalt milled up normally coming in granulated form, it has become apparent that this machine is not suited for reclaimed asphalt torn up in a different manner, so-called asphalt material broken up, as well as asphalt lumpy in another manner, e.g. return material from laying of asphalt.

As it appears from NATIONAL ASPHALT PAVEMENT ASSOCIATION, information series 71, No. 11/79, it is generally known to use asphalt milled up mixed with fresh bitumen and gravel aggregate for the production of a new asphalt product. As it appears from this article, it is of essential importance that the moisture content of the asphalt milled up, which when laid on road surfaces usually contains about 1% of water, is kept as low as possible during the production. It is thus required that the stored asphalt mass taken up preferably must be stored in as large pieces as possible since the absorption of moisture depends on the size of the granules, the more moisture being absorbed the smaller the size of the granules is. For the feeding of the screening and mixing part of the asphalt mixing machine it is, however, preferred that the individual admixed asphalt pieces do not have a maximum dimension exceeding about 5 to 7 cm. Consequently, it is usually preferred not to granulate the asphalt taken up until immediately before it is to be fed to the screening and mixing part.

The known granulating apparatuses cannot be used in connection with lumpy reclaimed asphalt deriving from return material from the laying of asphalt and from asphalt broken up in another manner than by milling, especially since these large lumps of material of a high viscosity have a great tendency to form bridges in the hopper and furthermore to lock the tearing means.

The object of the present invention is to provide a dosage granulator which also is suited for tearing up lumpy reclaimed asphalt into the desired granule size while simultaneously measuring the amount desired for each mixing process in such a manner that only the amount of reclaimed asphalt immediately to be used is granulated.

The dosage granulator according to the invention is characterized in that at least one funnel-shaped tearing up device is located under the feed hopper, and that the conveying member is formed as a weighing apparatus controlling the tearing up device through a sensing and signal member.

According to a simple embodiment according to the invention, the tearing up device comprises latticed side walls, between which two oppositely rotating tearing rollers are placed, and the sensing and signal member controls at least the rotation of the tearing rollers in response to the amount of granulated material desired in each instance. The oppositely rotating tearing rollers counteract formation of bridges and cut up efficiently the asphalt lumps into the desired size of granules by co-operating with the latticed side walls.

By situating the tearing up device and its tearing rollers a short distance below the hopper and not within said hopper it is furthermore ensured that the material in an improved manner slides better downwards towards the tearing up device, which is made additionally wide by two tearing rollers being situated under the hopper.

It is preferred that the tearing rollers carry sets of reversible knives projecting at regular intervals, and that the tearing rollers are driven in such a direction that the material is carried towards the latticed side walls of the tearing up device, whereas the knives are situated along spiral lines in such a direction that the material falling through the hopper is driven away from the middle of the hopper and outwards towards the partially open sides to be granulated against the latticed side walls. This embodiment contributes further in reducing the formation of bridges in connection with large lumps of asphalt.

According to a practical embodiment the latticed side walls are formed as gratings comprising substantially vertically extending slots, so that the material upon being pressed through said slots may immediately fall down on the conveying member situated below, said gratings preferably being shaped as interchangeable bars.

So as to further reduce the risk of formation of bridges, a stirrer is in accordance with the subject matter of the characterizing clause of claim 5 present in the form of stirring poles, which through a tilting movement alternately press the viscous material against one or the other tearing roller at the same time as they break down possible formations of bridges in the narrowest portion of the feed hopper. It is preferred that the stirrer is driven independently of the tearing rollers. So as to further increase the feed of the material of high viscosity towards the tearing rollers, the tearing up device comprises in accordance with the subject matter of the characterizing clause of claim 6 reciprocating pressure arms, which by engagement from above and downwards through the slots of the gratings and by co-operating with the stirrer press the material downwards towards the space between the tearing rollers and the gratings. So as to permit cleaning of the dosage granulator and to correct operational deficiencies in case a too large stone should have fallen into the tearing roller area, the pressure arms are hinged so that they may be swung down, whereby the gratings can be quickly opened for removing a stopping object. Furthermore, it is possible to loosen possibly lumped material by inserting a crawbar through the slots in the gratings.

In order to ensure that exactly the desired amount is produced during each cycle, the conveying member shaped as a weighing apparatus is formed as a conveyor type weigher, which through the sensing member and an electric control circuit is capable of actuating and stopping the driving means of the tearing rollers, the pressure arm shafts and particular actuating means for the stirring shafts in response to the desired amount of material. This embodiment turned out in practise to be the simpliest construction.

Beyond the fact that it is possible to regulate the amount of granulated material per time unit by regulating the rate of rotation of the tearing rollers, it turned out to be advantageous to ensure an additional regulation possibility in the instances when only a relatively small amount of reclaimed asphalt is to be used for each cycle. For this purpose both or only one tearing roller in each tearing up device may be driven as desired. So as to ensure in the latter case that the material slides uniformly through the hopper, the embodiment dealt with in the characterizing clause of claim 9 has proved suitable in practise.

The subject matter of the characterizing clause of claim 10 ensures a simple embodiment of the driving system.

Figure 2:
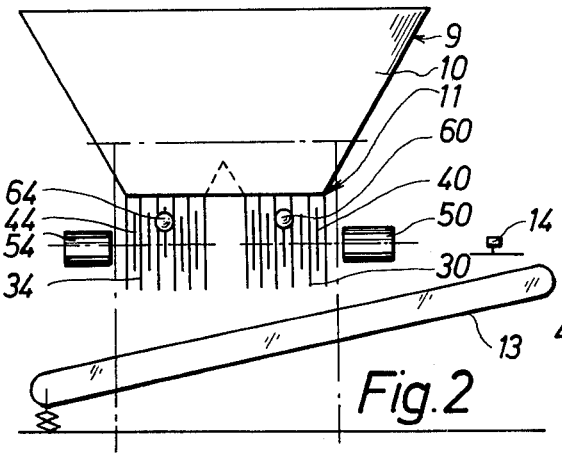
Figure 3:
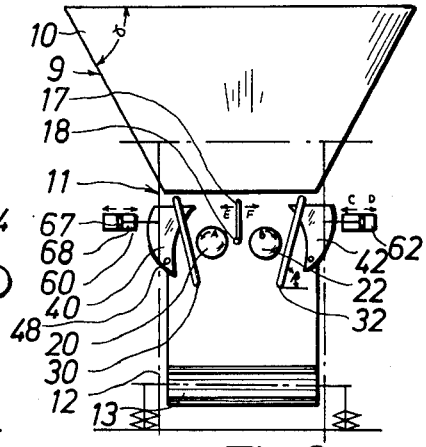
Figure 4:
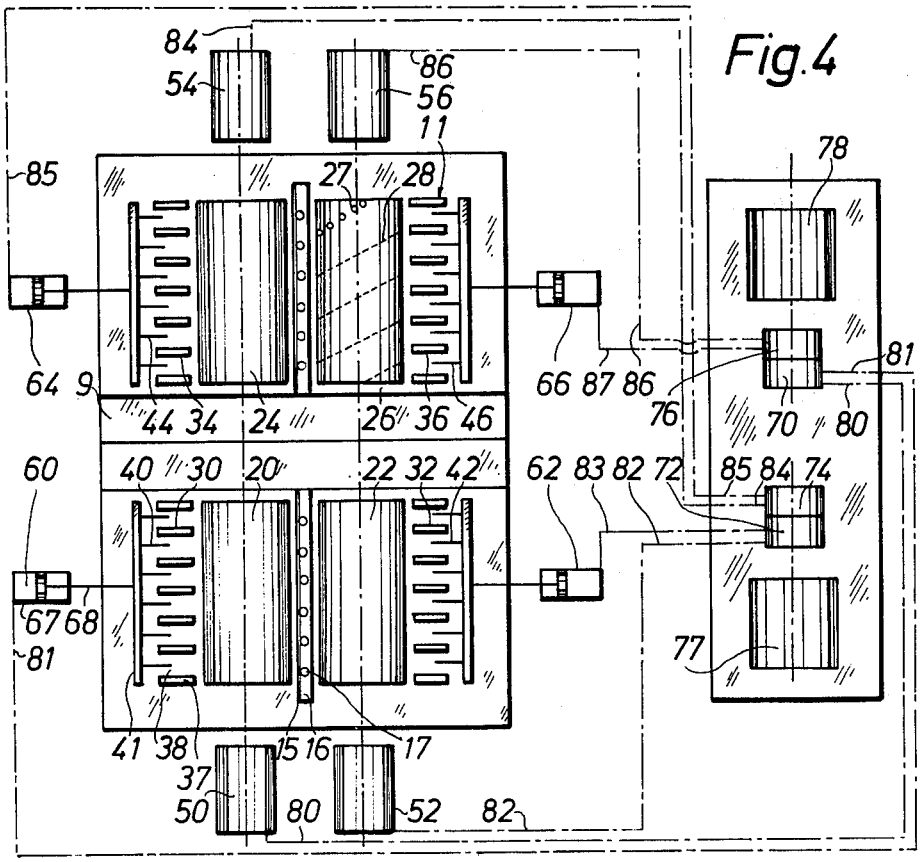

A preferred embodiment of the present invention is described more detailed below with reference to the accompanying drawing, in which FIG. 1 is a diagrammatic view of a machine system for reuse of reclaimed asphalt, FIG. 2 is a diagrammatic, front view of a dosage granulator according to the invention, FIG. 3 is a side view of the dosage granulator illustrated in FIG. 2, and FIG. 4 is a diagrammatic, top view of the dosage granulator of FIGS. 2 and 3 as well as of a driving circuit controlling the movable parts of the dosage granulator.

FIG. 1 illustrates a machine system for reclaiming asphalt materials, especially lumpy reclaimed asphalt deriving from return material from the laying procedure and from asphalt broken up, but said machine system may also be used for asphalt milled up. In principle, this machine system comprises a dosage granulator 1, an elevator or a conveyor 2, a conveyor type weigher 4, a weighing and introducing means 5 introducing granulated material into the mixing part 7 not described in detail of the asphalt mixing machine, an exhaust system 6 inter alia being connected to said machine. In order to ensure that only material of the correct size reaches the screening and mixing part, a grating (at 8) may be coupled between the conveyor 2 and the conveyor type weigher 4, through which only material of the correct size may pass. Subsequently, the discharged material 3 may be returned to the granulator for another granulation, if necessary.

The dosage granulator 1 according to the invention is suited for granulating material of high viscosity, especially lumpy reclaimed asphalt. The feed hopper 9 with its walls 10 and the tearing up device 11 located thereunder are supported by a diagrammatically illustrated base 12, on which a catwalk not illustrated also may be placed about the largest opening of the feed hopper. The entire tearing up device 11 is situated immediately under the lower opening of the feed hopper 9. A conveying member is suspended under the tearing up device 11 in the base 12, said conveying member preferably being a conveyor type weigher 13 with a sensing and signal member 14 associated therewith.

In the shown embodiment, two tearing up devices 11 are present, each comprising two tearing rollers 20, 22, 24, 26 with associated gratings 30, 32, 34, 36, and pressure arms 40, 42, 44, 46 hinged outside the gratings, as well as removable stirrers 15 inserted between the tearing rollers.

On each tearing roller 20, 22, 24, 26, which only appear from FIGS. 3 and 4, a great number of substantially cubical reversible knives 27 are mounted which preferably comprise eight cutting edges. It is preferred that the knives are placed along spiral lines placed in such a manner that the knives contribute to guide the asphalt in the desired direction. In operation, the tearing rollers are rotated in mutually oppositely directed directions, cf. the arrows A and B in FIG. 3, in such a manner that they transport the material outwards towards the gratings 30 to 36.

The gratings are formed as a plurality of interchangeable, and preferably reversible bars 37, which in a manner not described in detail are located so that they can be removed in order to facilitate the access to possibly lumped asphalt mass blocking the operation of the machine.

The pressure arms 40 to 46 are in sets connected by means of transverse arms 41 and at the bottom hinged on a shaft 48 so as to move in a reciprocating manner between the bars 37 of the gratings 30 to 36 and towards the tearing rollers 20 to 26. The pressure arms comprise preferably a curved, preferably circular front surface facing the tearing rollers and end at the top in a cusp end, which can penetrate into and cut up larger lumps of asphalt.

The tearing rollers 20 to 26 are driven by means of their respective hydraulic activating motor 50 to 56 in the rotational direction indicated by the arrows A and B. The pressure arms are activated by means of their respective associated hydraulic cylinder 60 to 66, which by means of a piston 67 and a piston rod 68 are connected to the transverse arms 41 of the pressure arms 40 to 46. The motive power of the hydraulic activating means is generated by four hydraulic pumps 70 to 76, which in turn are driven by two electromotors 77, 78. Hydraulic pipes 80 to 87 connect, cf. FIG. 4, each hydraulic pump to a hydraulic activating motor and a hydraulic cylinder. The hydraulic pump 70 is for instance connected to the hydraulic activating motor 50 and the hydraulic cylinder 60 through the pipes 80 and 81. It should be noted that the electric motor 77 thus through the pumps 72, 74, the pipes 82, 84, and the motors 52, 54 activates two diagonally opposing tearing rollers 22, 24, i.e. one in each tearing up device, and that the electric motor 78 drives the two other, diagonally opposing tearing rollers 20, 26 through the means 70, 80, 50, and 76, 86, 56.

The stirrer 15 coupled between each pair of rollers comprises a shaft 16 with stirring poles 17 located thereon. The shafts 16 are activated in a reciprocating movement by an activating means not shown in the drawing for the sake of clarity. The stirrer, and especially its stirring poles are mounted in such a manner that they may be removed easily in case the dosage granulator exclusively is to be used for asphalt milled up.

During operation, an appropriate amount of reclaimed asphalt of the type stated is filled into the feed hopper 9, and subsequently the motors 77 and 78 as well as possibly the motors for the stirrers 15 are actuated. As shown, the electric motor 77 activates the pressure arms 42 and 44 through the hydraulic cylinders 62 and 63 and the hydraulic pumps 72 and 74, in addition to driving the tearing rollers 22 and 24. In a corresponding manner the pressure arms 40 and 46 of the electric motor 78 are activated. During the granulation, the pressure arms 40, 42, 44, 46 are moved in a reciprocating manner in the direction of the arrows C and D, whereas the stirring poles are moved in a reciprocating manner in the direction of the arrows E and F while the tearing rollers rotate in the direction of the arrows A and B. In this manner the supplied lumps, the largest dimension of which must not exceed essentially 30 cm, are fed and carried by the stirring poles 17 and the knives 27 of the rollers outwards towards the bars 37 of the gratings 30, 32, 34, 36. Simultaneously, the curved pressure arms try to press the lumps downwards towards the space between the tearing rollers and the gratings, said procedure also being performed in co-operation with the stirring poles 17. Since the stirring poles 17 are driven by independent means (not shown), these poles operate asynchronously with the pressure arms 40, 42, 44, 46 in such a manner that even large lumps may be catched between said stirring poles and the pressure arms and be partially cut up therebetween prior to the additional pressing downwards into the space between the tearing rollers and the gratings. This co-operation of the various parts of the tearing up device 11 ensures that even large lumps of for instance 30×30 cm may be efficiently cut up into a particle size, the maximum dimension of which does not exceed 5 to 6 cm and preferably is less than 5 cm. The granulated material falls down on the conveyor type weigher 13, which being loaded by the desired amount stops the electric motors 77 and 78 and consequently and tearing up device 11 as well as the activating means of the stirrer at a signal from the sensing and signal member 14. The latter signal simultaneously actuates the conveyor belt 13 transferring the material fed thereon to the conveyor 2 advancing the granulate to the screening and mixing part 7. The amount of asphalt granulated per time unit can be partially regulated by adjusting the rate of rotation of the tearing rollers, but it may also be additionally adjusted stepwise by using only two tearing rollers during a granulation cycle. As to the sliding downwards through the hopper, it has proved advantageous in this connection to operate the tearing rollers "crossed" in such a manner that the tearing roller 20 co-operates with the tearing roller 26 and operates together with the associated parts with the final number 0 and 6, cf. FIG. 4, whereas the sensor through a control panel not shown at the next cycle ensures that the remaining two tearing rollers 22 and 25 with the associated parts with the final number 2 and 4 operate during said next cycle.

Beyond using a conveyor type weigher advancing the material, it is also possible to use a relatively slow dosage belt, the amount of material on the belt controlling the tearing rollers.

As mentioned, the dosage granulator is to be used for reclaimed materials such as asphalt material milled up in cold or hot state as well as broken up asphalt materials as well as residues from the production and the laying procedure. The capacity of the granulator highly depends on the nature of the reclaimed materials, the capacity being lowest when large amounts of broken up asphalt are fed, and exceptionally it may be necessary to break up said asphalt further into pieces of a maximum size of 30 cm. Since the reclaimed materials usually only will be used for part of the production, there should always be sufficient time for carrying out the granulation. Depending upon the reclaimed material available, the granulator is adjusted to operate with two or four tearing rollers. Since the raw materials may vary much, it should continuously be checked whether an appropriate balance in the flow is present. Since the reclaimed materials are "dead" materials, it must be avoided to dump whole shovelfuls of asphalt into the hopper. Preferably, the materials are sprinkled into the hopper, and an overloading must be avoided. The apparatus must be emptied every night and be sprayed with oil on the inside and on the rollers. Use of reclaimed materials containing macadam (tarmac) and stones above the size of shingles, i.e. above 40 to 50 mm must not occur.

The knives of the rollers must be turned as soon as they are worn and a knife can be turned up to eight times. This replacement may either be carried out from below or from the side, the bars 37 of the gratings being easily removable, as well as the pressure arms 40 to 46 are mounted so as easily to be turned downwards or completely removed.

The above embodiment of the dosage granulator according to the invention is preferred at present, but it is obvious to a person skilled in the art that various modifications can be performed concerning the embodiment. Thus an interval-controlled vibrator can be added. Furthermore, the conveyor type weigher may be replaced by a weighing cart, and the individual hydraulic motors may be replaced by for instance synchronized electric motors or other corresponding driving or activating means.

I claim:

1. A dosage granulator for tearing up a lumpy material having a high viscosity, especially reclaimed asphalt, comprising a feed hopper having a lower edge, a funnel shaped tearing up apparatus placed below said hopper, said tearing up apparatus comprising side walls with vertically extending slots therethrough through which material having the proper size and the granulated material can pass orthogonally to said side walls, said tearing up apparatus comprising at least one tearing up device comprising two oppositely rotating tearing rollers having horizontal axes which extend parallel with said side walls which side walls are placed symmetrically with one on each side of said tearing up device and wherein said slotted side walls of said funnel-shaped apparatus slope downwardly from an area near and a small distance below the lower edge of said feed hopper in a direction toward and closely adjacent the periphery of said tearing rollers, said slotted side walls having lower ends terminating a short distance below a lower common tangent plane of said tearing rollers, thus forming a funnel, each of said tearing up devices further including a plurality of essentially vertically and upwardly extending pressure arms which at least partly extend through said slots in said side walls, said plurality of pressure arms being fixed on a drive shaft placed outside of said side walls, the axis of said shaft extending parallel with the axes of said tearing rollers, which pressure arms are reciprocated in said slots in a direction toward and away from the periphery of said tearing rollers by means of said shaft and a driving mechanism.

2. A dosage granulator in accordance with claim 1 further comprising a conveying member placed under said tearing up device, said conveying member including a weighing apparatus for regulating the amount of granulated asphalt produced by said tearing up apparatus by means of a sensing and signal member.

3. A dosage granulator in accordance with claim 2, wherein said sensing and signal member is adapted to start and stop at least the rotation of said tearing rollers depending upon an in each case desired amount of granulated material.

4. A dosage granulator as claimed in claim 2, wherein the side walls of the tearing up device are gratings comprising substantially vertically extending slots and preferably being shaped as interchangeable bars.

5. A dosage granulator in accordance with claim 1, in which said tearing rollers carry sets of mutually spaced outwardly extending knives and in which said side slotted walls include a plurality of mutually spaced, essentially vertically extending bars, said tearing rollers of each tearing up device during operation being driven individually by roller motors in a direction such as to transport said high viscosity material independently away from the median line between said tearing rollers and wherein said knives on each of said tearing rollers are placed to contribute to force said material in the desired direction outwardly towards said side walls and through respective slots between said bars.

6. A dosage granulator in accordance with claim 1, wherein said pressure arms comprise a curved front surface facing said tearing rollers and extending concentric with the periphery of said tearing rollers and wherein at least some of said pressure arms at the top end in a cusp.

7. A dosage granulator in accordance with claim 1, wherein said side walls consist of mutually spaced, essentially vertically extending bars, and are suspended so that they may be opened to remove large stones and other non-tearable matter.

8. A dosage granulator for tearing up a lumpy material having a high viscosity, especially reclaimed asphalt, comprising a feed hopper having a lower edge, a funnel shaped tearing up apparatus placed below said hopper, said tearing up apparatus comprising side walls in the form of gratings with vertically extending slots therethrough through which material having the proper size and the granulated material can pass orthogonally to said side walls, said tearing up apparatus including at least one tearing up device comprising two oppositely rotating tearing rollers having horizontal axes which extend parallel with said side walls which side walls are placed symmetrically with one on each side of said tearing up device and further including a plurality of essentially vertically upwardly extending pressure arms which at least partially extend through said slots in said side walls and which are carried by shafts having axes extending parallel with the axes of said tearing rollers, said slotted side walls sloping downwardly from an area near and a small distance below the lower edge of said feed hopper in a direction toward and closely adjacent the periphery of said tearing rollers, said slotted side walls having lower ends terminating a short distance below a lower common tangent plane of said tearing rollers, thus forming a funnel, said dosage granulator further comprising a conveyor type weigher placed under said tearing up device, said weigher including weighing apparatus for regulating the amount of granulated material produced by said tearing up apparatus, said weigher being responsive to the desired amount of material, by means of a sensing and signal member and an electric control circuit, to start and stop a drive means for said tearing rollers.

9. A dosage granulator as claimed in claim 8, including two tearing up devices located side by side, said conveyor type weigher through the sensing and signal member and an electric control circuit being capable of starting and stopping the entire equipment of said apparatus in response to the needed amount of material to be granulated per time unit in such a manner that only the desired number of tearing rollers with the associated pressure arms are driven.

10. A dosage granulator in accordance with claim 8, wherein said electric control circuit comprises two mutually independent driving motors, which for each tearing up device drive their respective hydraulic pump, each pump in turn driving the roller motor in such a manner that each driving motor drives two diagonally opposing roller motors and an actuating cylinder for the pressure arms as well as at least one stirrer.

* * * * *